US009506257B2

(12) United States Patent
Bennett et al.

(10) Patent No.: US 9,506,257 B2
(45) Date of Patent: Nov. 29, 2016

(54) PORTABLE RESILIENT FLOATING FENCING FLOOR SYSTEM

(71) Applicant: Radical Fencing LLC, New York, NY (US)

(72) Inventors: Philippe Bennett, New York, NY (US); Konstantin Bardakh, Edgewater, NJ (US)

(73) Assignee: Radical Fencing, LLC, New York, NY (US)

( * ) Notice: Subject to any disclaimer, the term of this patent is extended or adjusted under 35 U.S.C. 154(b) by 0 days.

(21) Appl. No.: 14/615,992

(22) Filed: Feb. 6, 2015

(65) Prior Publication Data

US 2016/0230401 A1 Aug. 11, 2016

(51) Int. Cl.
*E04F 15/22* (2006.01)

(52) U.S. Cl.
CPC ..... *E04F 15/225* (2013.01); *E04F 2203/08* (2013.01); *E04F 2290/02* (2013.01)

(58) Field of Classification Search
None
See application file for complete search history.

(56) References Cited

U.S. PATENT DOCUMENTS 3,920,242 A * 11/1975 Reith ..... A63B 69/02 463/47.1
4,030,731 A * 6/1977 Delcayre ..... A63B 69/02 340/323 R
4,316,297 A * 2/1982 Geist ..... A63B 6/00 5/420
4,930,280 A 6/1990 Abendroth
5,277,010 A 1/1994 Stephenson et al.
5,836,853 A 11/1998 Marciano
6,612,968 B1 9/2003 Alvaro
6,669,601 B2 12/2003 Marciano
6,700,051 B2 3/2004 Aldridge (Continued)

FOREIGN PATENT DOCUMENTS

DE 199 27 213 C1 11/2000
GB 2 126 106 A 3/1984

OTHER PUBLICATIONS

"Aluminium Fencing Pistes," http://www.google.com/url?sa=t&rct=j&q=&esrc=s&source=web&cd=2&cad=rja&uact=8&ved=0CCwQFjAB&url=http%3A%2F%2Fshop.pbtfencing.com%2Ffencingequipments%2F211.html&ei =QmPCVOL0LYKmggT5soPoAQ&usg=AFQjCNEekjOMHkEu7DOIm34FQw7A7x4L8w, taken from the internet on Jan. 22, 2015 (one (1) page).

(Continued)

*Primary Examiner* — Brian Glessner
*Assistant Examiner* — Adam Barlow
(74) *Attorney, Agent, or Firm* — Davidson, Davidson & Kappel, LLC

(57) ABSTRACT

A portable fencing track that is readily assembled and disassembled at different venues includes a series of modular panels disposed adjacent to one another and interconnected to form an elongated central fencing floor. A piste or strip of electrically conductive material is placed and positioned with respect to the elongated central floor, and a perimeter floor is arranged so as to surround the central floor and the piste or strip. A threshold, preferably adjoining each of the modular panels located adjacent to the perimeter flooring, has lateral and end sections overlying adjacent portions of the strip and the perimeter floor, and at least one of the threshold sections defines a channel to receive wiring. Support elements are mounted to each of the floor panels and the perimeter floor to resiliently support the floor panels and the perimeter floor on a base surface and minimize damage over time to the ankles or hips of fencers. A process of assembling the track is also discussed.

24 Claims, 7 Drawing Sheets

(56) References Cited

U.S. PATENT DOCUMENTS

| | | | | |
|---|---|---|---|---|
| 7,127,857 | B2 | 10/2006 | Randjelovic | |
| 8,075,409 | B1 * | 12/2011 | Zivkovic | A63B 69/02 14/71.3 |
| 8,098,982 | B2 | 1/2012 | Nakayama | |
| 8,136,312 | B2 | 3/2012 | Hallsten | |
| 8,291,665 | B2 * | 10/2012 | Sondermann | E04F 19/061 52/459 |
| 8,348,770 | B2 | 1/2013 | Hart | |
| 2004/0231286 | A1 | 11/2004 | Alton et al. | |
| 2006/0100022 | A1 | 5/2006 | Linsay | |
| 2006/0211541 | A1 | 9/2006 | Abbondanzio et al. | |
| 2009/0020953 | A1 * | 1/2009 | Hallsten | A63B 69/02 273/309 |
| 2012/0028721 | A1 | 2/2012 | Johnson et al. | |

OTHER PUBLICATIONS

"AF FIE Certified High Raise Final Strip (20 meter X 3.5 meter)—Absolute Fencing Gear—Fencing Equipment," AF Absolute Fencing Gear: The absolute best.™, http://www.absolutefencinggear.com/shopping/product_info.php/products_id/1225/cPath/58_61, taken from the Internet on Jan. 22, 2015 (three (3) pages).

"Thread: Bamboo Floor??", fencing.net, http://www.fencing.net/forums/thread37751.html, posted Aug. 20, 2008, taken from the internet Jan. 22, 2015 (four (4) pages).

"Sports & Games::Combat Sports::Fencing::PISTE image—Visual Dictionary Online," Merriam-Webster, http://visual.merriam-webster.com/sports-games/combat-sports/fencing/piste.php, taken from the Internet on Jan. 22, 2015 (two (2) pages).

"Nitropanel International—Portable Floor System Specification," Action Floor Systems LLC, http://www.actionfloors.com/sys_nitropanel_int.shtml, posted in 2014, taken from the Internet on Jan. 23, 2015 (two (2) pages).

Brite, "Action Floor Systems NitroPanel," Architect: The Magazine of the American Institute of Architects, May 7, 2010, http://www.architectmagazine.com/flooring/action-floor-systems-nitropanel.aspx, (three (3) pages).

"Action Floor Supplies Playing Surface for Polish Disabled Athletes Competition," Newsline, Oct. 2010 vol. 40, American Sports Builders Association, (seven (7) pages).

"Action NitroPanel®: Portable Sports Floor Systems," 1996, Action Floor Systems LLC, (two (2) pages).

Abendroth, "Competitive Advantage," Sports Flooring, 2011, pp. 166-170, PanStadia, (five (5) pages).

"The Importance of En Standards," About EN-DIN Certification Standards, Action Floor Systems LLC, (one (1) page).

"DIN Rating—Ohio Floor—Connor Custom Sports Floors, et al." The Ohio Floor Company, 2011, taken from the internet on Jan. 29, 2015 (five (5) pages).

* cited by examiner

PORTABLE RESILIENT FLOATING FENCING FLOOR SYSTEM

BACKGROUND OF THE INVENTION

Field of the Invention

The present invention concerns a novel portable fencing floor system with resilient and compliant elements to absorb impact protecting fencers from floor related injuries and improving their performance over time that can be assembled and disassembled easily at different venues.

Description of Related Art

Developments associated with electromechanical and electronic scoring are regularly being incorporated into the sport of fencing. Such developments include U.S. Pat. No. 8,348,770 to Hart, which discloses a machine for facilitating the scoring of a fencing match that includes first and second fencing cord inputs, an optional third input for connection of a fencing piste, and a data link to a computing device connected to a display, and U.S. Pat. No. 6,612,968 to Alvaro and U.S. Patent Application Publication 2006/0211541 to Abbondanzio et al., both of which relate to touch detecting arrangements including detectors or sensors disposed at ends of weapon blades. Recently, U.S. Patent Application Publication 2012/0028721 to Johnson et al., moreover, generally concerns existing electronic fencing scoring systems, including wires that are kept taut by spring-wound reels at ends of fencing pistes and floor cables that may connect fencers to control boxes, and particularly relates to a tactile signaling apparatus intended to complement such existing electronic fencing scoring systems. U.S. Pat. No. 6,700,051 to Aldridge and U.S. Patent Application Publication 2006/0100022 to Linsay relate to wireless scoring systems for fencing.

Specialized surfaces and flooring have also been developed as playing surfaces suitable for use in various sports including fencing. U.S. Pat. No. 8,136,312 to Hallsten, for example, relates to a conductive fencing strip laid on a fixed hard floor, for example, laid on top of concrete, or recessed into an existing floor where the flooring is removed. The fencing strip is composed of interconnected conductive aluminum sections having a top surface of traction enhancing grooves, and an undersurface with secure rubber strips. The rubber strips are described as acting to reduce or eliminate the clanging of the aluminum on the supporting floor, as providing positive friction with the floor upon which the aluminum fencing strip is laid, and as providing a better feeling to the floor surface. U.S. Pat. No. 8,075,409 to Zivkovic, for example, also discloses a segmented conductive fencing strip, however, it incorporates light assemblies embedded beneath the fencing strip, in communication via a connecting cable system with a scoring controller and console. The segments of this fencing strip are mounted on stringers to which buckets or wells containing the lighting elements are attached. The stringers also distribute the load of the strip. U.S. Pat. No. 4,930,280 to Abendroth and U.S. Pat. No. 8,898,982 to Tucker, Jr. both concern sports floor systems adapted to be laid on a rigid supporting slab incorporating damping mechanisms, such as resilient rubber pads or air bladders that are spaced apart, coupled or integrated with the flooring structure. U.S. Pat. No. 5,277,010 to Stephenson et al. relates to a sport floor system using compressible floor supports with pneumatic resiliency.

SUMMARY OF THE INVENTION

A portable fencing track that is readily assembled and disassembled at different venues includes a series of interconnected modular panels disposed in relation to one another to deliver a stable resilient floating floor with an electrically conductive fencing strip centrally positioned and flush with the surrounding surfaces of this fencing track. A perimeter floor is arranged surrounding the conductive strip so as to border the underlying central floor upon which this strip is positioned. A threshold, preferably adjoining each of the modular panels, is located adjacent to the perimeter flooring and the electrically conductive fencing strip to receive and channel wiring. Support elements are mounted to each of the floor panels and the perimeter floor to resiliently support the floor panels and the perimeter floor on a base surface and minimize the force returning to the fencer from impact when the fencer lunges, jumps, fleches or otherwise moves. Over time this resilient and compliant supporting fencing track helps lessen physical injury to the fencer, including to her hips, knees, shins, or ankles. A process of assembling the track is also discussed.

In a preferred arrangement, the perimeter floor includes stringers disposed on an underside thereof, with the support elements of the perimeter floor being mounted to the stringers. The threshold can be connected and/or integrated with the modular panel for greatest assembly and disassembly efficiency, with laterally extending threshold flanges having undersides resting on the adjacent portions of the strip and the perimeter floor. The track could be one of a plurality of tracks surrounded by perimeter flooring. The perimeter floor may be provided with a receptacle for a spring-wound reel, and/or mounting for scoring and lighting fixtures.

The perimeter floor may include a pair of lateral perimeter floor sections and a pair of end perimeter floor sections, with each of the lateral and end sections of the perimeter floor including the stringers mentioned. In one preferred embodiment, the channel forming threshold is disposed between the perimeter floor and the central floor. In this preferred embodiment, the threshold itself can include a pair of sides and a bottom that collectively form a concavity, as well as a top that closes off the concavity to form a wiring channel. The threshold top defines laterally extending flanges having undersides resting on the adjacent portions of the strip and the perimeter floor. It will be appreciated by those skilled in the art that the threshold may also be readily formed by creating adequate space and using the lateral side wall of the perimeter flooring and placing an upper cover or shield over this space.

The invention is intended to be readily assembled and disassembled at different locations, and should serve to help reduce floor related injuries and over time positively affect fencer overall performance. The track forming the subject matter of the invention is shock absorbing and resilient, can be placed temporarily or semi-permanently, if not permanently, on numerous different existing surfaces, and enhances the fencing playing field. The present inventive fencing floor system applies and integrates some features and aspects of college and professional indoor basketball, volleyball, and handball playing surfaces into a specially designed flooring system that integrates a conductive fencing strip, absorbs shock from the fencer's movements by reducing the force the floor returns to the fencer, namely, is resilient, acts to reduce harsh impacts caused by traditional flooring, even concrete, and reduces the problematic impact of raised edges of metal strips that can be an issue.

DETAILED DESCRIPTION OF THE INVENTION

Figure 1:
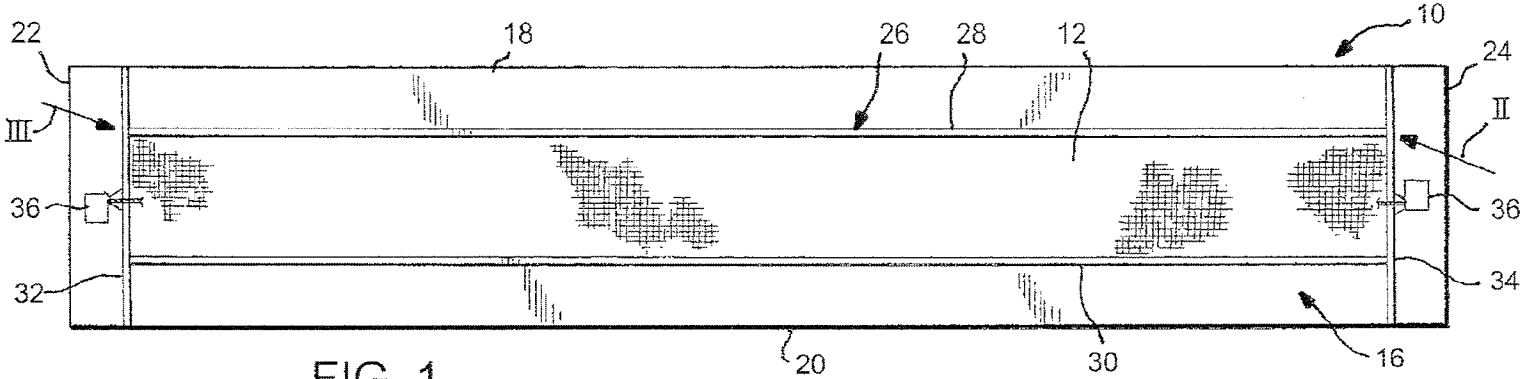
FIG. 1 is a plan view from above a track formed by an assembled floating sport/exercise floor, piste, and perimeter floor combination according to the invention.
Figure 2:
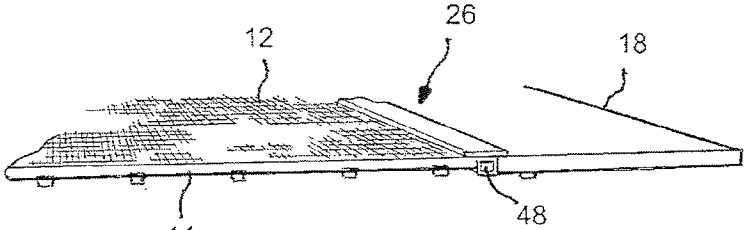
FIG. 2 is a sectional view of a threshold positioned between the central floor and an adjacent lateral perimeter floor section of the combination illustrated in FIG. 1.
Figure 3:
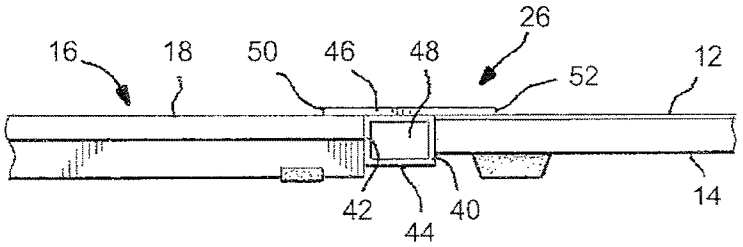
FIG. 3 is a view similar to that of FIG. 2 but slightly enlarged and seen from the opposite end of a threshold.
Figure 4:
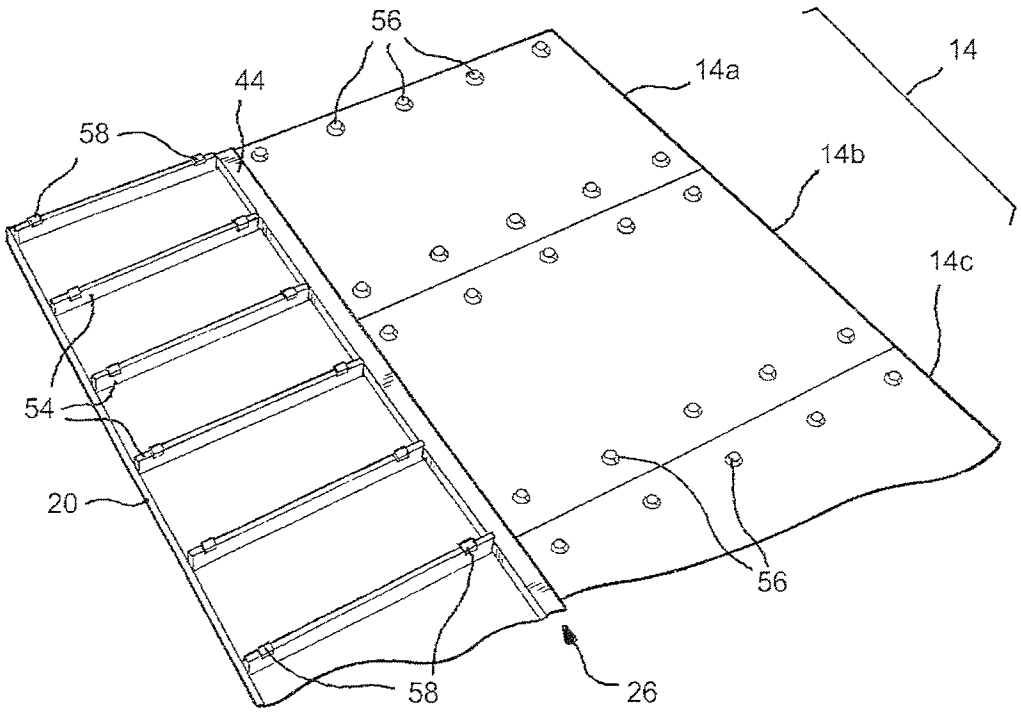
FIG. 4 is a view illustrating undersides of the floating central floor and an adjacent lateral perimeter floor section.

An assembled floating sport/exercise floor, piste, and perimeter floor combination forms a track 10 illustrated in FIG. 1, which is a plan view from above that track. A conductive piste or strip 12, mounted on a stable, resilient, floating central floor 14 that is visible in FIGS. 2, 3, and 4, is shown in FIG. 1 as surrounded by a perimeter floor 16. By way of example only, in the fencing application envisioned here, the strip 12 will have overall dimensions of 17 meters by 1.5 meters. The perimeter floor 16 shown includes a first pair of sections 18 and 20, which are disposed laterally relative to the overall track 10 and roughly parallel to each other, and a second pair of sections 22 and 24, which are disposed at ends of the track 10 and roughly parallel to each other as well.

Figure 5:
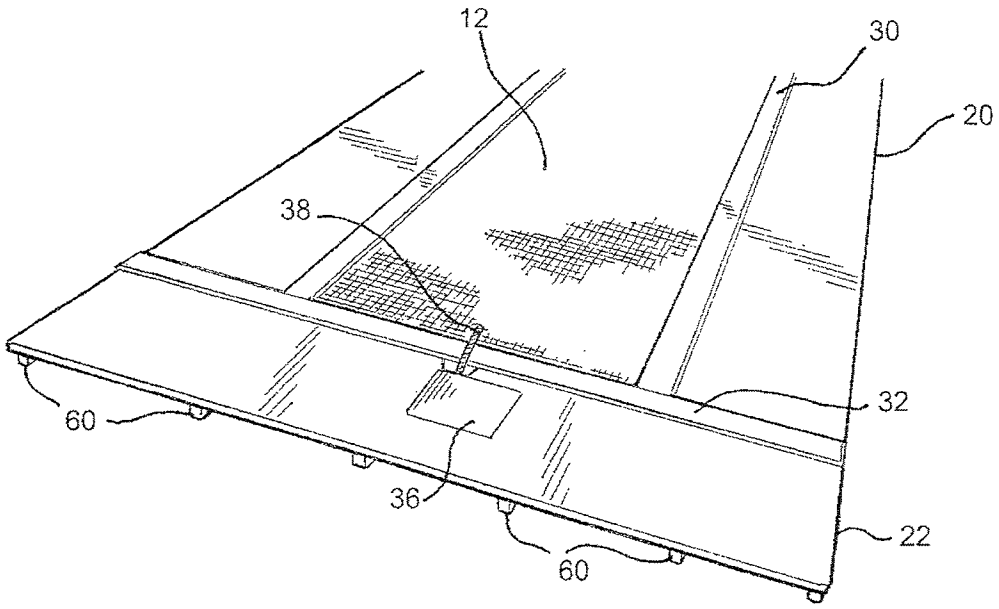
FIG. 5 is a perspective view of one end of the track shown in FIG. 1.

Also illustrated in FIG. 1 is the upper surface of a threshold 26, which serves several purposes, to be described. The threshold 26 includes a first lateral section 28 at a junction between the lateral perimeter floor section 18 and the strip 12, a second lateral section 30 at a junction between the lateral perimeter floor section 20 and the strip 12, a first end section 32 at a junction between the end perimeter floor section 22 and the strip 12, and a second end section 34 between the end perimeter floor section 24 and the strip 12. Each of the end perimeter floor sections 22 and 24 includes a pocket, cutout, or other receptacle dimensioned to receive the case 36 of a spring-wound reel. In a conventional manner, the reel mentioned is used to pay out and rewind wire 38 (FIG. 5) connected, via a body cord in the apparel of a competing fencer, to the weapon of the fencer as he or she moves up and down the strip 12 during a match. The reel is in turn interconnected, by appropriate plugs and cables, to an electronic scoring system, such as that formed by the central scoring console of the Zivkovic ('409) patent, the scoring machine, computing device, and display of the Hart ('770) patent, the scoring machine of the Abbondanzio et al. ('541) publication, or the control box of the Johnson et al. ('721) publication identified above.

The cross sectional configuration of at least one section or part of the threshold 26 is shown in FIGS. 2 and 3, with FIG. 2 being a view in the direction of arrow II in FIG. 1, and FIG. 3 being a view in the direction of arrow III in FIG. 1. This section or part of the threshold 26 includes, in cross section, a pair of parallel sides 40 and 42, a bottom 44, and a top 46, defining the upper surface visible in FIG. 1. The threshold 26 serves to both cover spaces between the strip 12 and the sections of the perimeter floor 16 and to provide channels that can receive wiring electrically communicating connections to the strip 12 and/or the reels in the cases 36 with the electronic scoring system. The threshold sides 40 and 42 and the threshold bottom 44 collectively form an approximately "U" shaped concavity that is closed off by the top 46 to form a channel 48 extending throughout the length of the particular part or section of the threshold 26. The threshold top 46 extends laterally beyond the sides 40 and 42 to define flanges 50 and 52, having undersides respectively arranged to rest on the perimeter floor 16 and the conductive strip 12. The undersides of the threshold flanges 50 are preferably permanently secured, by an appropriate adhesive or appropriate fasteners, to the upper surfaces of respective perimeter floor sections 18, 20, 22, and 24 in order to facilitate quick assembly and disassembly of the track 10. Appropriate wiring is preferably passed through the threshold channels 48 and electrical connections (not shown) are preferably put in place before connecting the threshold 26 to the perimeter floor 16. One of ordinary skill in the art would recognize that a threshold can be alternatively positioned along the outer edge of the perimeter flooring.

Undersides of the floating central floor 14 and an adjacent lateral perimeter floor section 20 are visible in FIG. 4. FIG. 4 also shows the bottom 44 of the threshold 26 disposed between the central floor 14 and the adjacent perimeter floor section 20. Each of the lateral perimeter floor sections 18 and 20 is provided on its underside with reinforcing ribs or stringers 54 that extend in the widthwise direction of those sections 18 and 20, as is evident from FIG. 4. The stringers 54 are preferably regularly distributed throughout the length of each section 18 and 20, although other distribution patterns are also envisioned. As is visible in the end view of the track 10 shown in FIG. 5, the end perimeter floor section 22 at an end of the track is also provided on its underside with reinforcing ribs or stringers 60, which are essentially the same as the reinforcing ribs or stringers 54 already discussed. The end perimeter floor section 24 is additionally provided with such reinforcing ribs or stringers on its underside, although these particular stringers are not visible in FIG. 5.

FIG. 4 further illustrates a plurality of resilient bumpers or support elements 56 distributed laterally across the underside of the central floor 14, causing the floor 14 to "float" above a surface upon which the floor is placed. Each stringer 54 is also shown as having a pair of resilient bumpers or support elements 58 located at its opposite ends. The resilient support elements 56 and 58 are intended to support the assembled track 10 upon the floor or the base surface on which the track 10 is placed, serve to prevent the assembled track 10 from sliding relative to that floor or other surface, and cushion the track relative to the floor or the base surface in order to minimize injury and impact over time to the hips, knees, shins or ankles of fencers. The support elements 56 and 58 may be secured in place to the central floor 14 and the stringers 54 by an adhesive, by screws or nails, or in other suitable attachment ways.

In the particular embodiment illustrated, the floating central floor 14 is composed of multiple separate panels to create a 17 meter by 1.5 meter platform and support the fencing piste or strip 12, which has those same 17 meter by 1.5 meter dimensions, as noted. The panels may be formed of wood, plastic, or other material that is adequately stiff and strong enough to support competitors during a fencing match. A series of the resilient support elements 56 may be secured to the underside of each of the floating central floor panels 14*a*, 14*b*, 14*c*, . . . , 14*n*, adjacent edges of those panels. FIG. 4 shows a series of five such elements 56 adjacent to the edges of three of the panels 14*a*, 14*b*, and 14*c*, although this is only one example of a variety of appropriate resilient support element arrangements. Each of the perimeter floor sections 18, 20, 22, and 24 could similarly be composed of multiple panels, with the stringers and resilient support elements pre-assembled to those perimeter floor panels. It will be appreciated by those skilled in the art that floating resilient athletic wood floor systems can be constructed of multiple modular panels where each panel 14*a*, 14*b*. 14*c*, . . . 14*n* combines both a central and perimeter floor, and that those floors that are rated and/or meet the compliance standards set by the ASTM and/or are EN co pliant will provide excellent shock absorption and will be satisfactory to meet the performance needs of a competitive or practice fencing surface.

Figure 9:
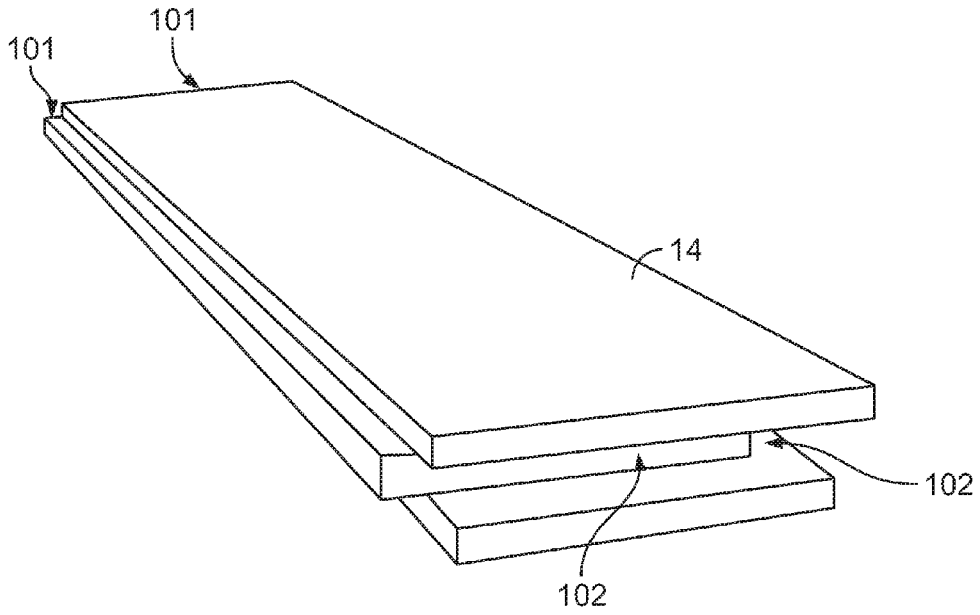
FIG. 9 illustrates interconnection elements for modular panels in the form of a tongue and groove joint.

Any type of relatively flat floor or base surface should be appropriate to support the track 10, including, for example, a gymnasium floor, the bottom of a track positioning channel, a concrete slab, and so on. By way of example only, one way to set up the track 10 might include initially placing the individual panels 14*a*, . . . 14*n* on the base surface and, optionally, securing those panels to the base surface. Although the resilient support elements 56 and 58 should suffice to keep the fencing track 10 in place as fencing matches occur, in some instances, it might be preferable to actually secure said track or parts thereof to the base surface with adhesive, or brackets and screws or other types of fastening means. The modular panels 14*a*, 14*b*, 14*c*, . . . 14*n* may be interconnected in a variety of different ways; for example, the panels may have notches and teeth oriented such that these notches and teeth of the adjacent panel fit with one another, or in the form of groove 102 and tongue 101 joint (FIG. 9) that either slide or snap in place, or having beveled cut ends of one panel cooperating with the beveled cut ends of the adjacent panel, or by way of fasteners disposed along opposite edges such as threaded fasteners, bayonet type fasteners, snap type fasteners, magnetic type fasteners or any other type fasteners suitable for mating modular floor panels together. Once the panels have been placed on the base surface to create the 17 meter by 1.5 meter platform mentioned, forming the floating floor 14, the conductive piste or strip 12 could be placed to the floor 14. It will be recognized by those of ordinary skill in the art that the piste or strip 12 is typically a stand-alone conductive mesh runner, perforated sheet metal, dimpled sheet metal, or laminated metal panel. The piste or strip 12, which can be recessed into the overall track, if desired, may be secured to the floating floor by varying means recognized by those of ordinary skill in the art subject to the choice of piste or strip material.

Once the conductive strip 12 is positioned on and combined with or integrated to the floating floor 14, the sections 18, 20, 22, and 24 of the perimeter floor 16 may be put in place around the strip and the floating floor. At this point, if it has not been installed previously, the case 36 of the spring-wound reel could be mounted in the pocket, cutout, or other receptacle of each end perimeter floor section 22, 24. By having the sections of the threshold 26 normally affixed to the threshold flanges 50 to the perimeter floor sections 18, 20, 22, and 24, by having wiring already in place within the wiring runways formed by the threshold channels 48, and by having electrical connections in place as well before connecting the threshold 26 to the perimeter floor 16, assembly of the perimeter floor 16 around the combined strip 12 and the floating floor 14 can occur rapidly.

Figure 6:
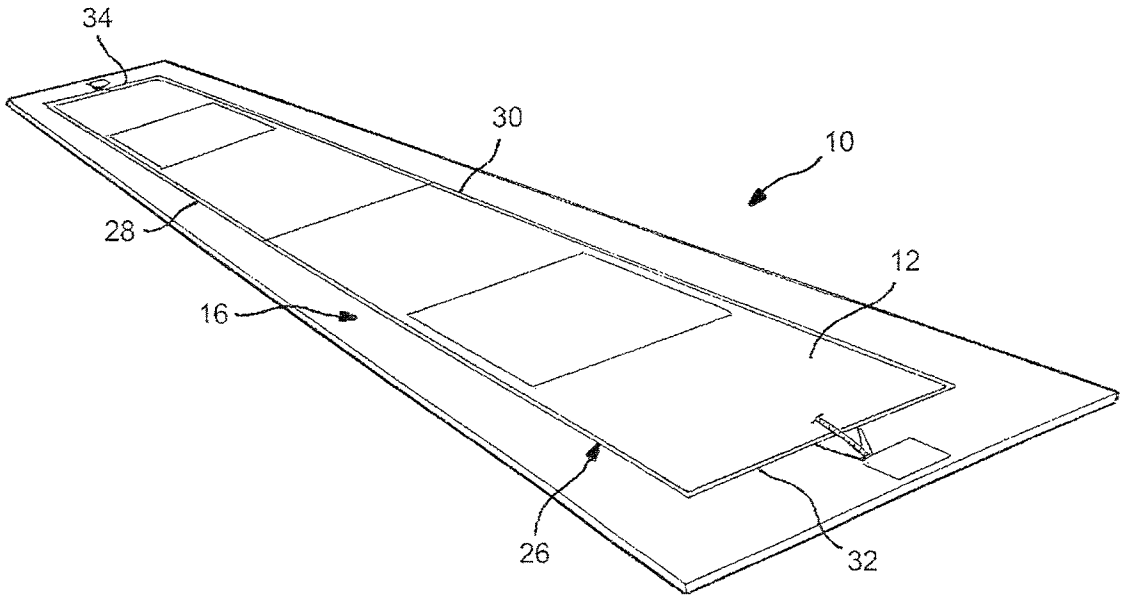
FIG. 6 is a perspective schematic view of a single track in an assembled condition, with the conductive strip, the perimeter floor, and the threshold visible.
Figure 7:
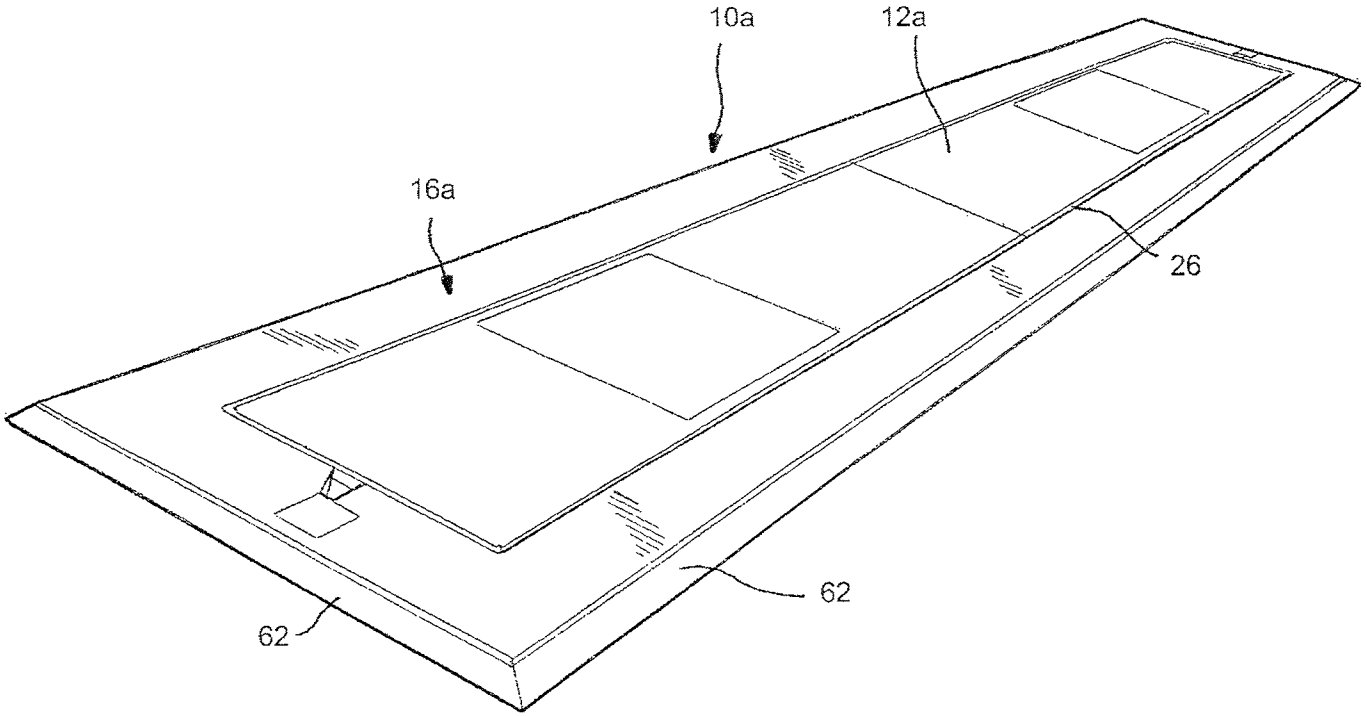
FIG. 7 is a perspective view of a single track similar to the track shown in FIG. 6 but in which the outside of the perimeter floor also includes a protective and ornamental flange or covering.
Figure 8:
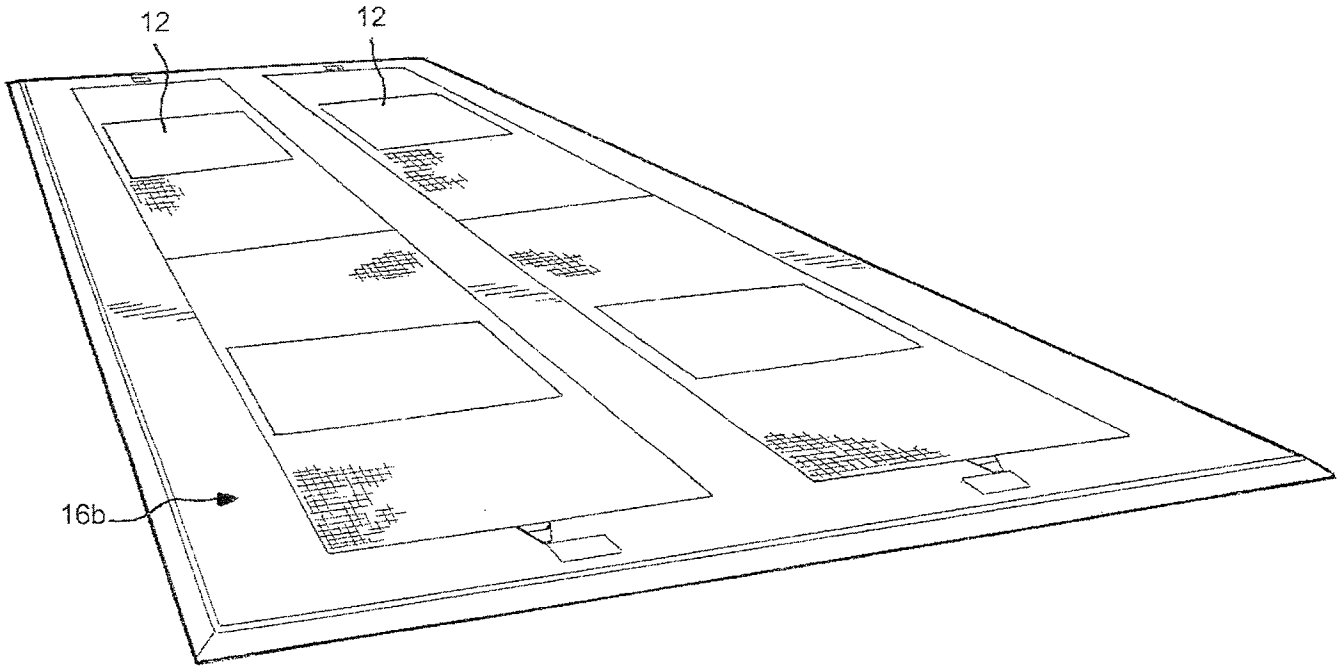
FIG. 8 illustrates an arrangement in which multiple pistes or strips are disposed in series within a unitary perimeter floor.

FIG. 6 is a perspective view of a single track 10 in an assembled condition, with the conductive piste or strip 12, the perimeter floor 16, and the threshold 26 all visible. In contrast to the arrangement illustrated in FIGS. 1-5, where the threshold end sections 32 and 34 extend over the entire longitudinal extent of the end perimeter floor sections 22, 24, in FIG. 6, the threshold end sections 32 and 34 extend only between, and terminate at, the threshold lateral sections 28 and 30, with all channels 48 of the threshold 26 in communication so that just a single cable outlet may be used. FIG. 7 is a perspective view of a single track 10*a*, with a conductive piste or strip 12*a*, a perimeter floor 16*a*, and a threshold 26*a* all visible. The track 10*a* shown in FIG. 7 differs from the track 10 shown in FIG. 6 in that each of the sections of the perimeter floor 16*a* of FIG. 7 includes a protective and ornamental flange or covering 62 projecting downward to the vicinity of the sub-floor base surface. Finally, FIG. 8 illustrates an arrangement in which multiple pistes or strips 12 are disposed in series within a unitary perimeter floor 16*b*.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A portable fencing track that is readily assembled and disassembled at different venues, comprising:

a series of modular panels disposed adjacent and interconnected to one another to form a stable resilient elongated floating floor, wherein the modular panels are interconnected to one another via interconnection elements;

a strip of electrically conductive material positioned on a top surface of said floating floor, a perimeter floor surrounding each modular panel, a top surface of the perimeter floor being flush with a top surface of the strip of electrically conductive material, the floating floor having the strip of electrically conductive material thereon and the perimeter floor forming a rectangular flat flooring surface, each side of the rectangular flat flooring surface having interconnection elements arranged to enable connection to a further rectangular flooring surface; and support elements mounted to each of the floor panels and the perimeter floor to resiliently support the floor panels and the perimeter floor on a base surface.

2. The track according to claim 1, wherein the perimeter floor includes stringers disposed on an underside thereof.

3. The track according to claim 2, wherein the support elements mounted to the perimeter floor are mounted to the stringers.

4. The portable fencing track according to claim 1, further comprising a threshold including threshold sections, each of the threshold sections having lateral walls a pair of sides directly adjoining said perimeter floor and said floating floor, as well as a bottom and a top spaced from the bottom by the pair of sides to define a channel to receive electrical wiring or transmission line.

5. The track according to claim 4, wherein the threshold defines laterally extending flanges having undersides resting on adjacent portions of the strip and the perimeter floor.

6. The track according to claim 1, wherein the strip is one of a plurality of strips, wherein each of the plurality of strips is disposed in a corresponding rectangular flooring surface.

7. The track according to claim 1, wherein the perimeter floor is provided with a receptacle for a spring-wound reel.

8. The track according to claim 2, wherein the perimeter floor includes a pair of lateral perimeter floor sections and a pair of end perimeter floor sections, and each of the lateral and end sections of the perimeter floor includes the stringers.

9. The track according to claim 4, wherein the perimeter floor includes a pair of lateral perimeter floor sections and a pair of end perimeter floor sections, and wherein one of the threshold sections is disposed between each of the perimeter floor sections and the central floating floor.

10. The track according to claim 4, wherein the threshold includes a pair of sides and a bottom that collectively form a concavity, and a top that closes off the concavity to form the channel.

11. The track according to claim 10, wherein the top of the threshold defines laterally extending flanges having undersides resting on adjacent portions of the strip and the perimeter floor.

12. A process of assembling a portable fencing track, comprising:

disposing a series of panels, on which resilient support elements are mounted, adjacent and interconnected to one another on a base surface to form an elongated central floor, providing a strip of electrically conductive material over the elongated central floor, providing surrounding the central floor and the strip of electrically conductive material flush with a perimeter floor on which resilient support elements are also mounted and having a threshold with including threshold sections, each of the threshold sections having a pair of sides directly adjoining said perimeter floor and said floating floor, as well as a bottom and a top spaced from the bottom by the pair of sides to define a channel to receive electrical wiring or transmission line, and surrounding the central floor and the strip of electrically conductive material flush with the perimeter floor having said threshold connected thereto so that lateral and end said sections of the threshold are adjoining adjoin portions of both the strip and the perimeter floor, and so that the floating floor having the strip of electrically conductive material and the perimeter floor form a flat flooring surface.

13. The process according to claim 12, wherein the perimeter floor includes stringers disposed on an underside thereof.

14. The process according to claim 13, wherein the support elements mounted to the perimeter floor are mounted to the stringers.

15. The process according to claim 12, wherein the threshold is permanently affixed to the perimeter floor.

16. The process according to claim 12, wherein the threshold defines laterally extending flanges having undersides resting on adjacent portions of the strip and the perimeter floor.

17. The process according to claim 12, wherein the strip is one of a plurality of strips surrounded by the perimeter floor.

18. The process according to claim 12, wherein the perimeter floor is provided with a receptacle for a spring-wound reel.

19. The process according to claim 13, wherein the perimeter floor includes a pair of lateral perimeter floor sections and a pair of end perimeter floor sections, and each of the lateral and end sections of the perimeter floor includes the stringers.

20. The process according to claim 12, wherein the perimeter floor includes a pair of lateral perimeter floor sections and a pair of end perimeter floor sections, and wherein one of the threshold sections is disposed between each of the perimeter floor sections and the central floating floor.

21. The track according to claim 4, wherein the threshold is permanently connected to the perimeter floor.

22. The portable fencing track according to claim 1, wherein the interconnection elements include one or more of: notches and teeth, a groove and tongue joint, threaded fasteners, bayonet type fasteners, snap type fasteners, and magnetic type fasteners.

23. The portable fencing track according to claim 1, wherein the perimeter floor is comprised of perimeter floor sections, and wherein each of the modular panels includes a central floor section having a portion of the strip of electrically conductive material recessed therein and a perimeter floor section.

24. The portable fencing track according to claim 1, further comprising a downwardly projecting flange at a perimeter edge of the rectangular flat flooring surface.

* * * * *